US005806755A

United States Patent [19]

Correll

[11] Patent Number: 5,806,755

[45] Date of Patent: Sep. 15, 1998

[54] PRODUCT-PROTECTING PIZZA CARTON

[76] Inventor: John D. Correll, 8459 Holly Dr., Canton, Mich. 48187

[21] Appl. No.: 589,892

[22] Filed: Jan. 23, 1996

Related U.S. Application Data

[63] Continuation-in-part of Ser. No. 278,258, Jul. 21, 1994, Pat. No. 5,586,716.

[51] Int. Cl.[6] ..... B65D 5/22

[52] U.S. Cl. ..... 229/110; 229/109; 229/177; 229/178; 229/906

[58] Field of Search ..... 229/109, 110, 229/116.1, 178, 177, 906

[56] References Cited

U.S. PATENT DOCUMENTS

| | | | |
|---|---|---|---|
| 2,819,833 | 1/1958 | Saver | 229/41 |
| 2,925,213 | 2/1960 | Zvkoski | 229/41 |
| 3,454,209 | 7/1969 | Persson | 229/145 |
| 4,389,013 | 6/1983 | Hall et al. | 229/915 |
| 4,700,843 | 10/1987 | Cohen | 229/906 |
| 4,765,534 | 8/1988 | Zion et al. | 229/109 |
| 4,801,077 | 1/1989 | Sweatt, III et al. | 229/906 |
| 4,919,326 | 4/1990 | Deiger | 229/109 |
| 4,984,734 | 1/1991 | Zion et al. | 229/109 |
| 5,000,374 | 3/1991 | Deiger | 229/109 |
| 5,014,853 | 5/1991 | Crock et al. | 206/602 |
| 5,110,038 | 5/1992 | Pantisano et al. | 229/103 |
| 5,118,032 | 6/1992 | Geho | 229/110 |
| 5,209,392 | 5/1993 | Anatro | 229/117.01 |
| 5,255,841 | 10/1993 | Ritter | 229/177 |
| 5,358,173 | 10/1994 | Mertz | 229/110 |
| 5,368,225 | 11/1994 | Ritter | 229/110 |
| 5,375,761 | 12/1994 | Sullivan et al. | 229/100 |
| 5,402,929 | 4/1995 | Ritter et al. | 229/110 |
| 5,476,214 | 12/1995 | Fisk, Jr. | 229/103 |
| 5,476,216 | 12/1995 | Roberjella et al. | 229/117.01 |
| 5,586,716 | 12/1996 | Correll | 229/906 |

*Primary Examiner*—Gary E. Elkins

[57] ABSTRACT

A pizza carton providing a high degree of product protection through employing one or more structural features including a warp-resistant cover panel to prevent the cover from contacting the pizza, product anti-slide cover flaps and movable diagonal walls to contain the product on eight sides while still providing a square corner for packing an extra item in the box, and quick-release corner connections and a specially contoured inner panel of a double-panel front wall to allow for slicing pizza in the box without need to slide the pizza back-and-forth. Also included is a method for making a box having a warp-resistant cover.

30 Claims, 4 Drawing Sheets

FIG-5
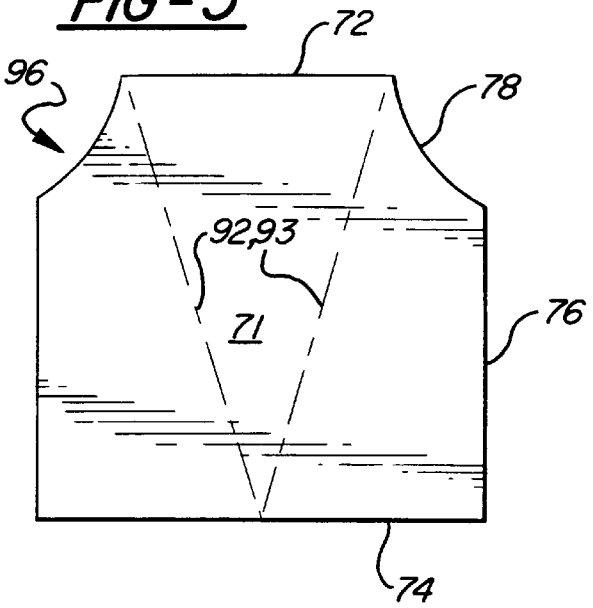
FIG-6
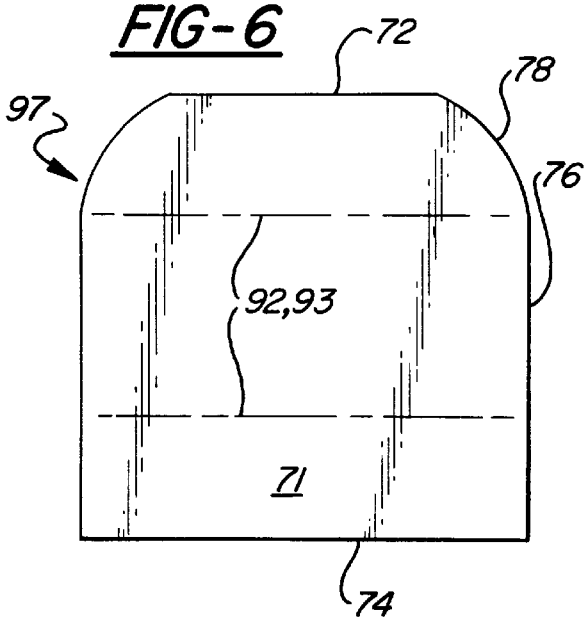
FIG-7
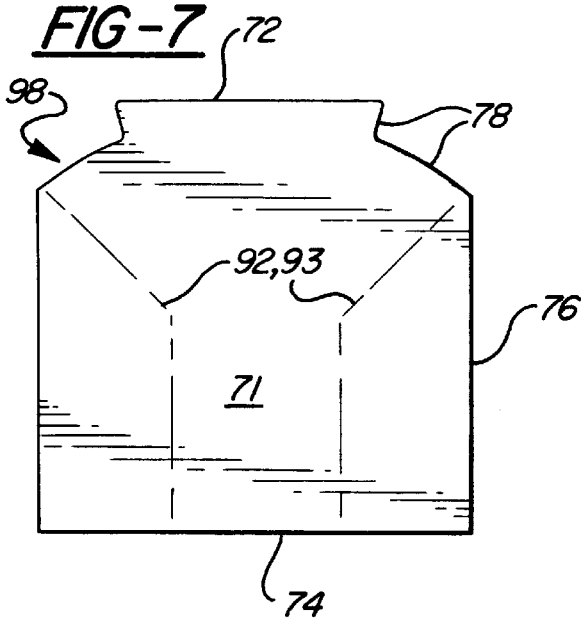
FIG-8
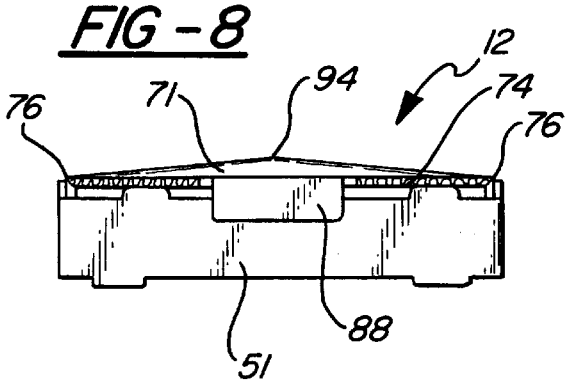
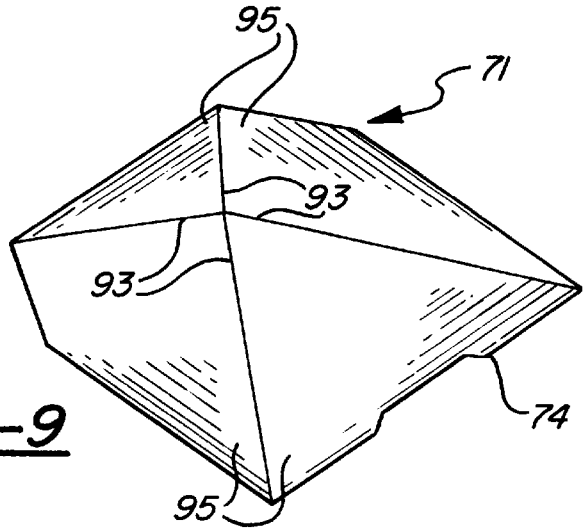
FIG-9

PRODUCT-PROTECTING PIZZA CARTON

CROSS-REFERENCES TO RELATED APPLICATIONS

This is a continuation-in-part application of my application Ser. No. 08/278,258, entitled "Designer-cover Box," filed Jul. 21, 1994, now U.S. Pat. No. 5,586,716.

FIELD OF THE INVENTION

This invention relates to cartons and, in particular, to boxes for relatively flat food products such as pizza and the like.

DESCRIPTION OF THE PRIOR ART

Millions of hot pizzas annually are packaged and transported in paperboard cartons. For a pizza to provide consumer satisfaction, the pizza carton must maintain the product in quality condition. A number of packaging-related factors impact upon pizza quality.

First, a carton should allow for a pizza to be cut in the box without having to slide the pizza back-and-forth. Currently, to cut a pizza in a typical box having a double-panel front wall, the pizza must be positioned rearward of center (often on a portion of the cover), cut, and then slid forward. The sliding action can cause slices to separate. This, in turn, can (a) create a messy-looking carton, (b) create a gap between slices which allows sauce and cheese to flow between, and (c) create an unattractive product presentation. So, there is a need for a double-panel front wall box that allows pizza to be positioned in the center of the tray member for cutting rather than being slid back-and-forth.

Second, a box should prevent pizza slices from sliding into corners of the carton during transport. When slice-sliding occurs, it creates a messy-looking pizza that customers dislike. To minimize slice-sliding, some companies use an eight-sided or octagon box. However, an octagon box lacks square corners and, therefore, cannot be used for packing extra items, such as a cup of sauce, in with the pizza. So, there is a need for a box with square corners that also minimizes slice-sliding.

Third, a box should have a cover that doesn't warp downward and contact the product. When a cover panel contacts the product, cheese sticks to the cover, resulting in consumer dissatisfaction. Corrugated pizza cartons are especially susceptible to cover warping. This can occur during warehousing and shipment and also when hot product is packed in the box. Steam from hot food causes the inside surface of the board to expand, making the center of the cover warp downward (or inward). Finally, warping is exacerbated when the box containing hot food is placed under a heat lamp.

To prevent a warped cover from contacting the pizza, some companies have adopted deeper boxes, with corresponding increase in packaging cost. Others use a plastic lid support that's placed in the center of the pizza. This also increases packaging cost and, some folks believe, detracts from the appearance of the pizza. So, there is a need for a box with a cover that is resistant to downward warping when holding hot food product.

Finally, with a typical pizza box having a double-panel front wall, there is a small gap between the two panels. Therefore, the tray member of the box must be one-fourth to one-half inch longer (front-to-back) than the diameter of the pizza to allow for this gap. Correspondingly, the cover panel must be longer, as well, to cover the tray. So, there is a need to eliminate the wasted space consumed by the gap between panels of a double-panel front wall.

There are a number of prior art non-square boxes that have the potential for reducing slice-sliding, those most similar to the invention being: Sauer U.S. Pat. No. 2,819,833 granted on Jan. 14, 1958; Zukoski U.S. Pat. No. 2,925,213 granted on Feb. 16, 1960; Zion U.S. Pat. No. 4,765,534 granted on Aug. 23, 1988; Deiger U.S. Pat. No. 5,000,374 granted on Mar. 19, 1991; Geho U.S. Pat. No. 5,118,032 granted on Jun. 2, 1992; Mertz U.S. Pat. No. 5,358,173 granted on Oct. 25, 1994; Ritter U.S. Pat. No. 5,368,225 granted on Nov. 29, 1994; and Ritter et al. U.S. Pat. No. 5,402,929 granted on Apr. 4, 1995.

Some of the above prior art boxes are octagon shape, thereby serving to eliminate slice-sliding. However, they also provide no square corner for packing a sauce cup in the box. Others have a combination of diagonal walls with square corners, thereby providing space for a sauce cup, but also thereby allowing a measure of slice-sliding. So, there remains a problem of how to eliminate slice-sliding while having a square corner for packing a sauce cup or other extra item with the pizza.

Pertaining to the need for a warp-resistant cover, there appears to be no prior art. The closest prior art relates to inventions pertaining to divisible covers and to easy-to-dispose cartons. The references include: Crockett U.S. Pat. No. 5,014,853 granted on May 14, 1991; Pantisano et al. U.S. Pat. No. 5,110,038 granted on May 5, 1992; Anatro U.S. Pat. No. 5,209,392 granted on May 11, 1993; Sullivan et al. U.S. Pat. No. 5,375,761 granted on Dec. 27, 1994; Fisk, Jr. U.S. Pat. No. 5,476,214 granted on Dec. 19, 1995; and Robertella et al. U.S. Pat. No. 5,476,216 granted on Dec. 19, 1995.

The above references either show detachable perf lines for dividing a cover panel into individual plates or for dividing a carton into disposable pieces or they show "latent destructive lines" for folding a used carton into a disposable bundle. None of the above prior art boxes provide for a warp-resistant cover. So, there remains a problem of how to eliminate cover-warping of pizza boxes without resorting to extra-deep cartons or costly lid support devices.

Pertaining to the need for eliminating wasted space in the gap of a double-panel wall, there appears to be no prior art. The closest is a stacking carton by Zion et al. U.S. Pat. No. 4,984,734 granted on Jan. 15, 1991. However, it does not solve the problem. So, there remains a problem of how to productively utilize the wasted space between panels of a double-panel wall.

By solving these problems in a cost-effective manner, it would enable a pizza to be cut and packaged in better condition and to be transported without damage to product quality, all at a reduction in packaging cost. In conclusion, it would be highly desirable to provide a box that overcomes the above-described problems and disadvantages.

OBJECT AND ADVANTAGES

Accordingly, the general object of my invention is a box, and an associated method, that provides a cost-effective means for protecting pizza during slicing and transport. More specifically, the object of my invention is a box that does one or more of the following: (1) allows pizza to be cut in the center of the tray member of a box having a double-panel front wall; (2) eliminates slice-sliding by containing a pizza on eight sides while also providing a square corner for carrying an extra item; (3) reduces cover warping and, thereby, eliminates need for deeper boxes or costly lid support devices; and (4) eliminates the wasted space consumed by the gap between panels of a double-panel wall.

The advantages of my invention are improved product quality, packaging versatility, and reduced cost.

Further objects and advantages of the invention will become apparent from consideration of the following detailed description, related drawings, and appended claims, all of which form a part of this specification.

SUMMARY OF THE INVENTION

In accordance with the invention, a carton is created that can incorporate one or more of the following features:

1) Square front corners that have quick-release corner interlock means, which is created in the preferred embodiments through side wall corner flaps having a tab projecting from a top edge which engages with openings in the front wall.

2) A cover having the means of reducing product sliding, which is created in the preferred embodiments through special side flaps with extension panels projecting from an end of the flap, the extension panels being disposed diagonally in the box.

3) A cover panel having warp-resistant means, which is created in the preferred embodiments through special fold lines and a special method which involves folding a cover panel along fold lines.

4) A construction for a double-panel wall that eliminates wasted space between the panels of the wall, which is created in the preferred embodiments through a recessed medial portion in the second panel.

5) A movable diagonal corner wall assembly, which in the preferred embodiments connects between a side wall and an end wall by means of a unique structure and arrangement of connector panels; in particular, a first connector panel having a first edge attached to a bottom edge of a diagonal wall, a second edge attached to a second connector panel, and a third edge free of attachement.

6) Opposing front and rear walls, first and second side walls disposed adjacent to the front wall, first and second non-parallel diagonal walls connected to a rear end of the side walls, and a cover connected to the rear wall.

The invention would be typically used for packaging relatively flat food products such as pizza, however it can serve other purposes, as well. A complete understanding of the invention can be obtained from the detailed description that follows.

BRIEF DESCRIPTION OF THE DRAWINGS

FIG. 5 shows a first alternate cover panel for a warp-resistant cover.

FIG. 6 shows a second alternate cover panel for a warp-resistant cover.

FIG. 7 shows a third alternate cover panel for a warp-resistant cover.

FIG. 8 is front elevation view of the box of FIG. 2 showing warp-resistant cover with raised middle area.

FIG. 9 is a perspective view of the cover panel of the box of FIG. 2 showing non-coplanar sub-panels.

LIST OF REFERENCE NUMERALS

Figure 1:
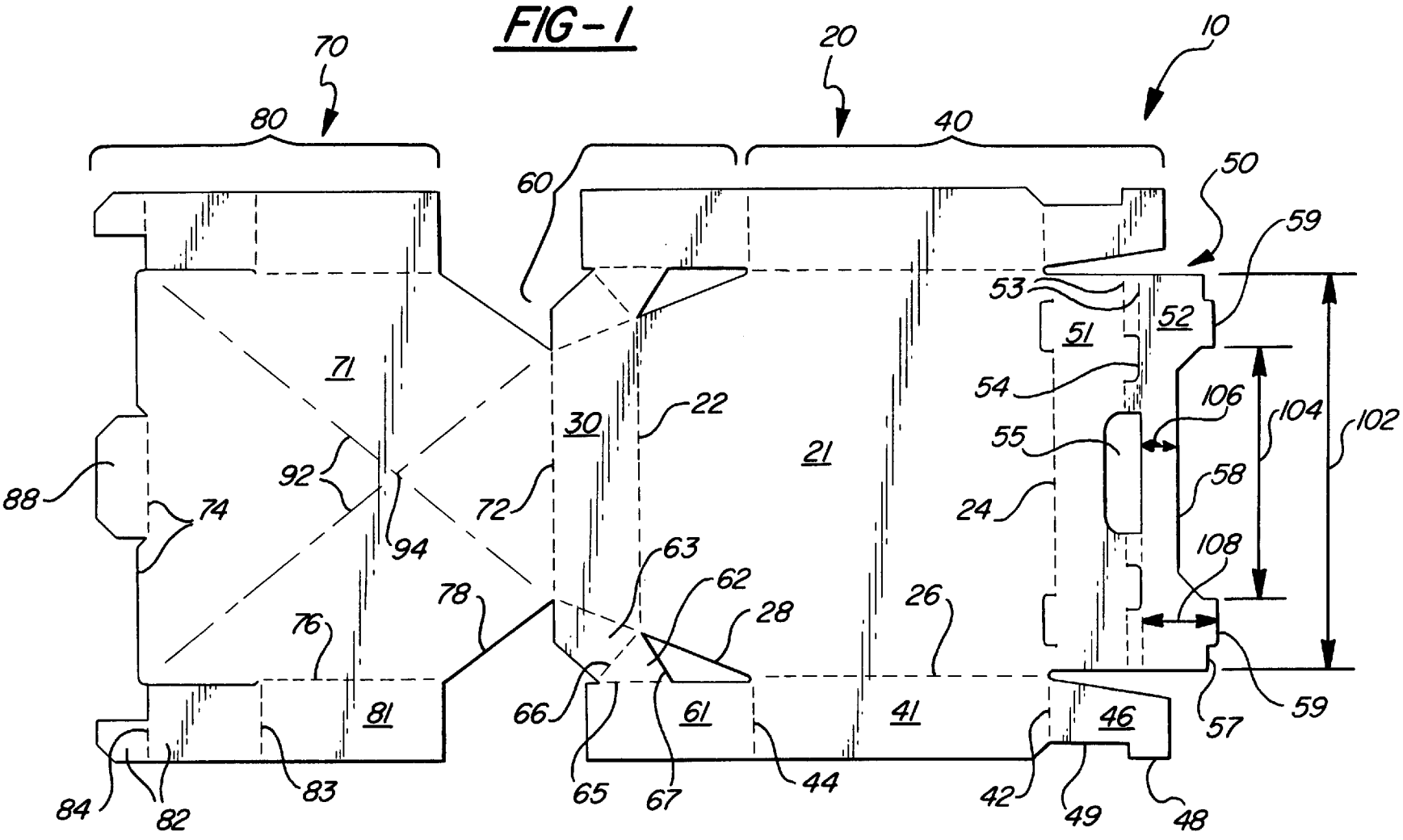
FIG. 1 is a blank of the first preferred embodiment of the invention.

Within a drawing, corresponding parts on opposite sides of a blank or box have similar reference numerals. Between drawings, like reference numerals designate corresponding parts.

| | |
|---|---|
| 10 | blank of first preferred embodiment |
| 12 | box of first preferred embodiment |
| 14 | blank of second preferred embodiment |
| 16 | box of second preferred embodiment |
| 20 | tray member |
| 21 | bottom panel |
| 22 | rear end edge |
| 24 | front end edge |
| 26 | side edge |
| 28 | corner edge |
| 30 | rear wall (structure) |
| 40 | side wall structure |
| 41 | side wall |
| 42 | front end |
| 44 | rear end |
| 46 | front corner flap |
| 48 | tab |
| 49 | top edge of corner flap |
| 50 | front wall structure |
| 51 | first panel |
| 52 | second panel |
| 53 | top edge (fold lines) |
| 54 | tab-receiving opening |
| 55 | cover interlock opening |
| 57 | irregular outer edge |
| 58 | recessed medial portion |
| 59 | interlock portion |
| 60 | corner wall structure |
| 61 | diagonal wall |
| 62 | first connector panel |
| 63 | second connector panel |
| 64 | third connector panel |
| 65 | first edge |
| 66 | second edge |
| 67 | third edge |
| 68 | diagonal wall corner flap |
| 70 | cover member |
| 71 | cover panel |
| 72 | top edge of rear wall/cover rear edge |
| 74 | cover front edge |
| 76 | cover side edge |
| 78 | cover corner edge |
| 80 | flap structure |
| 81 | main flap |
| 82 | extension panel |
| 83 | fold line |
| 84 | secondary fold line |
| 85 | flap |
| 88 | cover front flap |
| 89 | pair of front flaps |
| 92 | anti-warp means |
| 93 | flex-lines |
| 94 | intersection point |
| 95 | sub-panels |
| 96 | first alternate cover panel |
| 97 | second alternate cover panel |
| 98 | third alternate cover panel |
| 102 | length of second panel |
| 104 | length of recessed portion |
| 106 | minimum height of panel |
| 108 | maximum height of panel |

DESCRIPTION OF THE PREFERRED EMBODIMENTS

Explained first is the structure of the invention as applied to two preferred embodiments. This is followed by an explanation of the operation of the invention and its features.

Structure of the Invention

Referring now to the drawings, there are illustrated first and second preferred embodiments of the invention in one-piece blanks and, correspondingly, boxes created from the blanks. It will be appreciated, as the description proceeds, that the invention may be realized in different embodiments and may be used in other applications.

Figure 2:
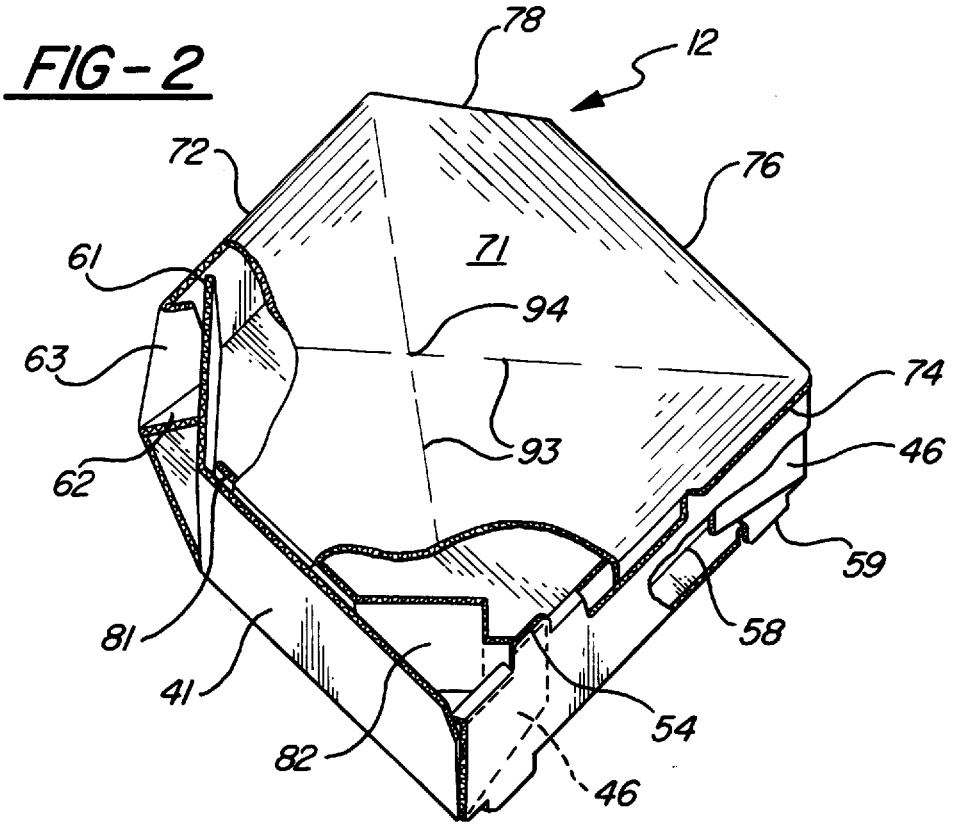
FIG. 2 is a perspective view of a box formed from the blank of the first preferred embodiment.
Figure 4:
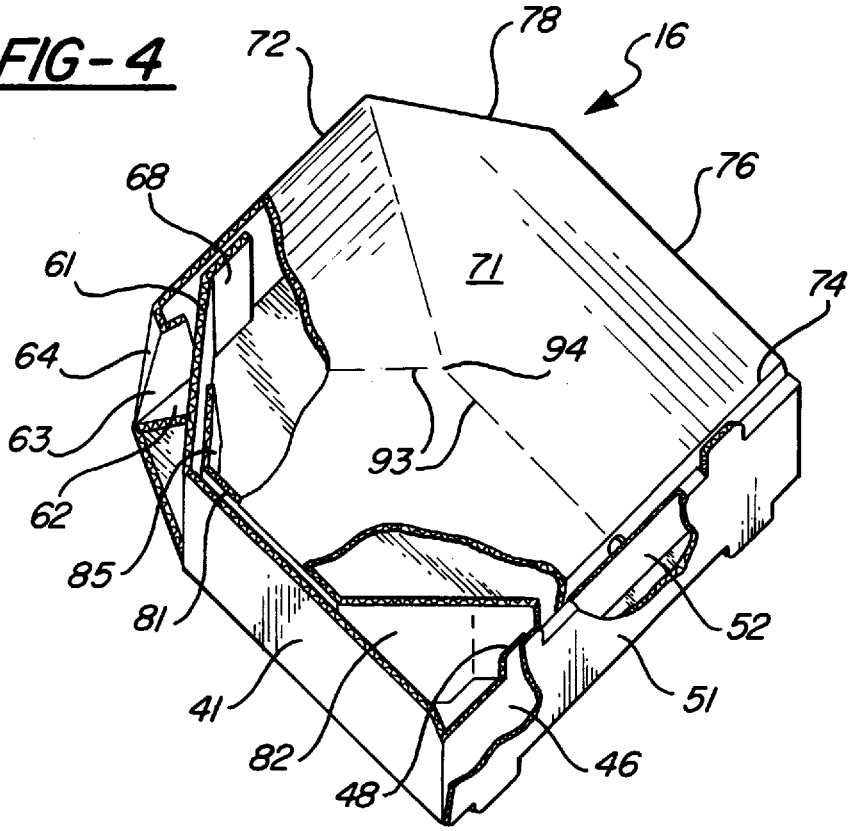
FIG. 4 is a perspective view of a box formed from the blank of the second preferred embodiment.
Figure 3:
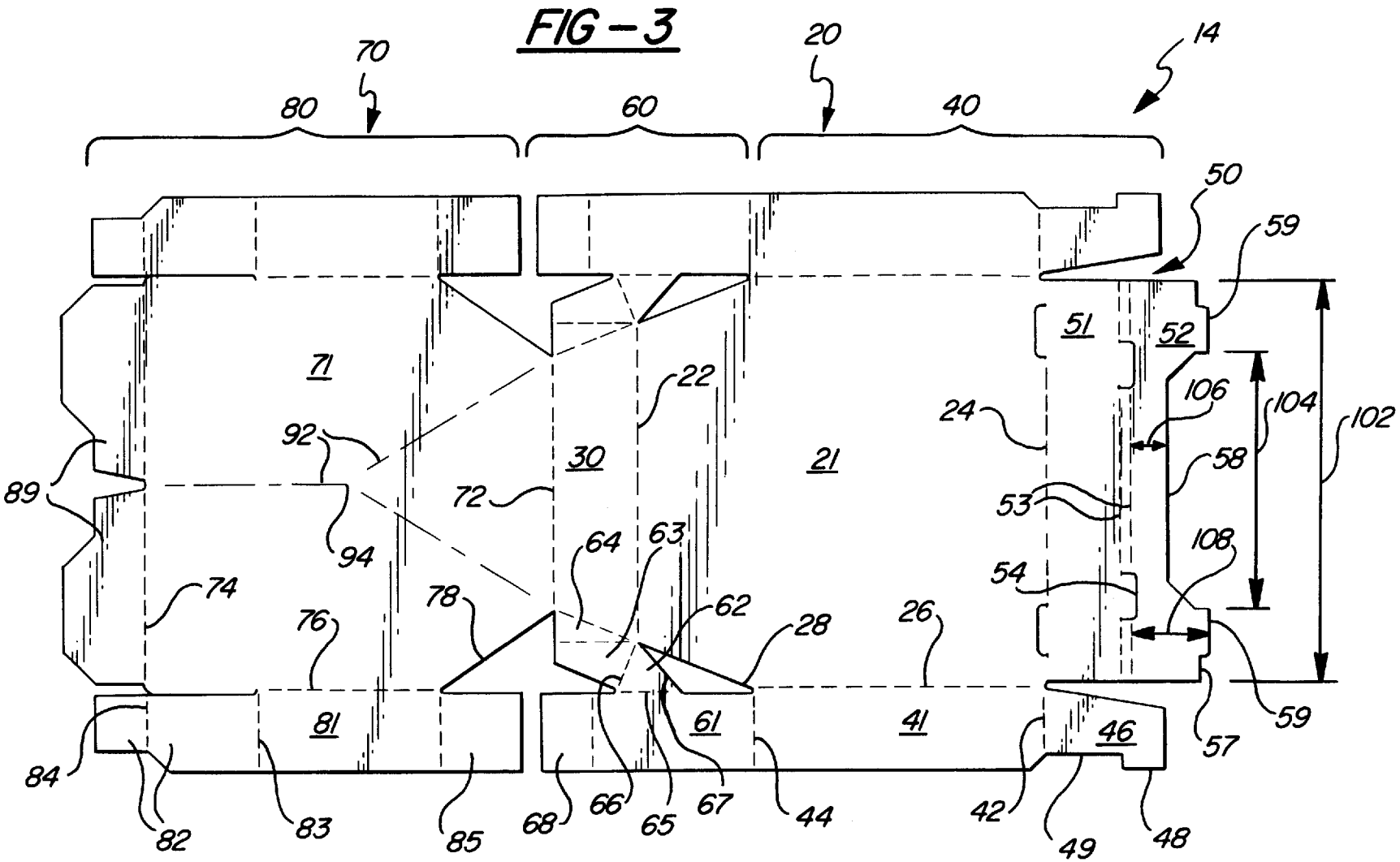
FIG. 3 is a blank of the second preferred embodiment of the invention.

FIGS. 1 and 2 show blank 10 and box 12, respectively, of the first embodiment. FIGS. 3 and 4 show blank 14 and box 16, respectively, of the second embodiment. The following discussion pertains to both embodiments except where noted when something applies to one embodiment only. All parts are labeled in the blanks and select parts are labeled in the boxes. Because the embodiments are bilaterally symmetrical, only parts on one side of a blank may be labeled. However, it is understood that a corresponding part on the other side is referenced by a same numeral. Also, corresponding parts between drawings share a same reference numeral.

Blanks 10 and 14 (and boxes 12 and 16) consist of a tray member 20 and a cover member 70. In tray member 20 there is a bottom panel 21 which has rear end edge 22, front end edge 24, a pair of side edges 26, and a pair of corner edges 28. A rear wall 30 is hingedly attached to edge 22. A front wall structure 50 is hingedly attached to edge 24. A pair of side wall structures 40 are hingedly attached to pair of edges 26. Extending between structures 40 and wall 30 are a pair of corner wall structures 60.

Side wall structure 40 comprises a side wall 41 having a front end 42 and a rear end 44. A front corner flap 46 is hingedly attached at end 42 and has a front wall engaging tab 48 projecting from a top edge 49.

Front wall structure 50 comprises a first panel 51 and a second panel 52 hingedly attached to panel 51 at a top edge 53. In the embodiments, the hinged connection between panels 51 and 52 is accomplished by a pair of narrowly-spaced parallel fold lines; however, this connection could also be achieved with a single fold line. For simplicity, a pair of narrowly-spaced parallel fold lines is treated as if it were a single line or edge. Therefore, reference numeral 53 indicates the top edge of panels 51 and 52 and also the pair of narrowly-spaced parallel fold lines.

When the blank is set up into a box, structure 50 becomes a double-panel wall with panel 51 becoming an outer panel and panel 52 becoming an inner panel. A pair of tab-receiving openings 54 are positioned at edge 53, or along the narrowly-spaced parallel fold lines. Openings 54 receive tabs 48 of flaps 46. This tab-and-opening assembly can function as a quick-releasing corner connection, allowing the front corners of the box to be easily disconnected for cutting pizza in the box. Contained within the first embodiment (blank 10 and box 12) is a cover interlock opening 55, which is shown as a cut-out section.

Second panel 52 has an irregular outer edge 57 which is opposite edge 53. When the blank is set up into a box, edge 57 is the bottom edge of panel 52. Edge 57 comprises a recessed medial portion 58 which is bounded on opposite ends by a pair of interlock portions 59 which are outlying portion 58. In box form, interlock portions 59 engage with bottom panel 21 to hold panel 52 upright.

Panel 52 has a predetermined length 102 and recessed medial portion 58 has a predetermined length 104. The panel also has a predetermined minimum height 106 which extends from edge portion 58 to top edge 53 and has a predetermined maximum height 108 which extends from edge portion 59 to top edge 53.

In the embodiments, length 104 is at least twenty percent of length 102 and height 106 is less than eighty percent of height 108. These proportional dimensions allow for a configuration of panel 52, specifically a recessed medial portion, that provides two advantages. First, a pizza can be centered on panel 21 and wall structure 50 can be erected with the pizza in place. This is possible because the recessed medial portion allows panel 52 to swing past the pizza and be locked into panel 21 without contacting the pizza. This cannot be easily accomplished, if at all, with the double-panel wall of a regular pizza carton. With a regular carton, the pizza must often be slid rearward to allow the second panel of a double-panel front wall structure to swing downward. This sliding can cause slices of the pizza to separate. Second, the edge of the pizza can be positioned underneath inner panel 52 and into contact with outer panel 51, which allows panel 21 to be of a slightly shorter dimension than that of a regular carton, resulting in a savings of material.

Corner wall structure 60 extends between side wall 41 and rear wall 30. Structure 60 comprises a diagonal wall 61 that is hingedly attached to rear end 44 of side wall 41. Wall 61 is linked to wall 30 by means of connector panels. The first embodiment (FIGS. 1 and 2) has a first connector panel 62 and a second connector panel 63. The second embodiment (FIGS. 3 and 4) has those two panels plus a third connector panel 64. In the embodiments, first connector panel 62 has three edges. A first edge 65 is hingedly attached to a bottom edge of wall 61 (the bottom edge of the wall being the edge that's adjacent panel 21). A second edge 66 is hingedly attached to panel 63. A third edge 67 is free of attachment. In the second embodiment, a diagonal wall corner flap 68 is hingedly attached to the rear end of wall 61.

In the first embodiment, second panel 63 is hingedly attached to wall 30. In the second embodiment, third panel 64 is disposed between panel 63 and wall 30 and is hingedly attached to each. In the blank of the embodiments, an open space or cut-out section is shown between wall 61 and bottom panel 21. It is anticipated that panel 62 could be of different shape than that shown in the embodiments and, thereby, could fill the space. It is further anticipated that edge 28 could be of different contour than that shown in the embodiments. These alternate configurations are regarded as being within the scope of the invention.

Cover member 70 comprises a cover panel 71 having a cover rear edge 72, a cover front edge 74, a pair of cover side edges 76, and a pair of corner edges 78. Panel 71 is hingedly attached to a top edge of wall 30 at edge 72. As such, the line indicated by reference numeral 72 serves to indicate both cover rear edge 72 and the top edge of wall 30.

Panel 71 of the blanks shown in FIGS. 1 and 3 has anti-warp means 92. As used herein, "anti-warp means" is defined as one or more score lines, or elongated crease-like indentations, in a cover panel of a blank for folding the panel to form a warp-resistant cover for a box. The score lines of anti-warp means would be described as "primary fold lines" as distinguished from "latent destructive lines" described by Robertella et al. (U.S. Pat. No. 5,476,216).

A "warp-resistant cover" is defined as a cover panel for a box that has been folded inwardly along one or more fold lines, the result being the creation of flex-lines in the cover panel. (Reference to folding a cover panel "inwardly" means to fold it so that the interior angle of the fold is on the bottom side of the cover panel as opposed to the top side; thereby causing the edges of the panel to come downward from a center point or middle area of the panel.)

Panel 71 of the boxes shown in FIGS. 2 and 4 has flex-lines 93. A "flex-line" is defined as (a) a fold line in a cover panel along which the cover panel can flex as warping occurs, or (b) a fold line in a cover panel which divides the panel into multiple non-coplanar sub-panels. After folding panel 71 of the blanks along anti-warp means 92, panel 71 (and hence cover member 70) is converted into a warp-resistant cover for a box, that cover comprising panel 71 having flex-lines 93 which divide panel 71 into sub-panels 95 (most clearly illustrated in FIG. 9).

In the first embodiment (FIGS. 1 and 2), anti-warp means 92, and flex-lines 93, take the form of two intersecting diagonal score lines, converging at an intersection point 94 and forming an X-shape. In the second embodiment (FIGS. 3 and 4), means 92, and flex-lines 93, take the form of three score lines converging at intersection point 94 and forming a Y-shape. The base leg of the "Y" extends forward from point 94 toward edge 74 and the top two legs of the "Y" extend rearward from point 94. FIGS. 5, 6, and 7 show first, second, and third alternate cover panels 96, 97, and 98, respectively, which illustrate alternate configurations for means 92 (and flex-lines 93) and for edge 78 of panel 71. It is noted that these cover panels are provided as examples and that other configurations are covered within the scope of the invention. It is also noted that panel 96 shows a pair of diagonal flex-lines forming a V-shape configuration with a bottom portion of the "V" being adjacent an edge of the cover panel.

In the first embodiment, a cover front flap 88 is hingedly attached to edge 74. In the second embodiment, a pair of front flaps 89 is shown. A purpose of having dual front flaps is to enhance the anti-warp capability of panel 71 when the panel is folded along the base score line of the "Y." Also, if the box is designed so that sideward pressure is applied upon the sides of the cover panel by the side walls of the box, the dual front flap configuration with a fold line between allows the cover to more readily bend upward, thereby providing even greater warp-resistance to the cover panel.

Cover member 70 has a pair of product anti-slide means 80 hingedly attached to edges 76 of panel 71. As used herein, "product anti-slide means" is defined as a structure that appends from a cover panel and that can be disposed between the contents and a corner of a box to reduce shifting of the contents within the box. In the embodiments, means 80 takes the form of a main flap 81 and an anti-slide extension panel 82 hingedly attached to the flap at edge 83. Panel 82 is divided into two portions by a secondary fold line 84. In the embodiments, the portion of panel 82 on the front side of line 84 has a shorter height than the portion on the rear side. In the second embodiment, an additional flap 85 is hingedly attached at a rear end of flap 81.

As shown in FIGS. 2 and 4, panel 82 extends diagonally across a front corner of the box. Pertaining to pizza, this panel serves to hold the product in position, thereby keeping slices from sliding into a corner, which can occur when the pizza is tilted or being transported. In the embodiments, the diagonal extension panel is used only in the front corners of the box. However, it is anticipated that similar panels could be used across rear corners of a square box. This would be regarded as being within the scope of the invention.

Within the context of the invention, a fold line can be created by a number of means such as, for example, by a crease or score in the board, by a series of aligned spaced short slits or "perforations" in the board, and by a combination of aligned spaced short and long slits. In some cases, when a long slit is bounded on the ends by a series of short slits or a score, the long slit may be slightly offset in alignment from the short slits or score for the purpose of creating a slot along the fold line when the blank is set up into a box. Nonetheless, the entire combination of long and short slits is considered to constitute a single fold line unless otherwise indicated. In addition, to create a fold line where one panel is folded 180° to lay parallel on another panel, the fold line may constitute two narrowly-spaced parallel scores or series of aligned slits. In this case, the two narrowly spaced parallel scores or series of aligned slits constitute a single fold line unless otherwise indicated. In conclusion, as referred to herein, a fold line is any line between two points on the blank or box along which the board is intended to be folded when the blank is being erected into a box or when the box is used. The type of fold lines shown in the drawings are presently preferred but it will be appreciated that other methods known to those skilled in the art may be used.

Operation of the Invention

To fold the blank of the embodiments into a box, the following procedure is recommended. First, fold side walls 41 to upright position and fold front corner flaps 46 inward. Second, fold panel 51 to upright position and fold panel 52 downward, thereby erecting the front wall of the box. At this point, there are two options. A first option involves folding panel 52 to be perpendicular to panel 51, allowing locking tabs 48 to engage into openings 54. A second option involves folding panel 52 all the way down until interlock portions 59 engage with panel 21. (The first option allows the front corners of the box to be subsequently disconnected for cutting pizza in the box; the second option creates "permanently" locked front corners.) Third, push diagonal walls 61 inward, causing them to "flip" into diagonal position. Fourth, fold cover panel 71 upright. Fifth, fold the cover panel along anti-warp fold lines 92 to create a warp-resistant cover. Sixth, fold side flaps 81 inward and fold extension panels 82 at a diagonal angle to flaps 81. Seventh, close the cover down over the tray and, simultaneously, fold front flap 88 or dual flaps 89 into place. Flap 88 is tucked into cut-out section 55 and flaps 89 are tucked inside the tray member.

The fifth step of the above procedure discloses a special method of making a box having a warp-resistant cover panel. Essentially, the method involves folding the cover panel inwardly along one or more fold lines within the panel, thereby creating flex-lines in the panel. For clarity of definition, it is noted that flaps appended to a cover panel are not part of the cover panel, per se. Therefore, the process of folding flaps appended to a cover panel should not be confused with folding the cover panel along fold lines contained within the panel.

After the method is applied to create a warp-resistant cover, the cover may slope upward from opposing edges or, in other words, may be higher in a middle area or at a middle point of the cover panel than at opposing edges of the panel. This is illustrated in FIG. 8 which shows a front view of the box of the first embodiment. It can also create a cover panel comprised of non-coplanar sub-panels. This is illustrated in FIG. 9 which shows a cover panel of the box of the first embodiment with sub-panels 95 being non-coplanar one to another. The degree of non-coplanar-ness has been exaggerated in the illustration to make the concept clear. In a real cover panel, the center would likely not be as high as shown in the drawing, resulting in the sub-panels being just slightly out-of-plane one to another.

If the first option for forming the front wall was utilized, a pizza can be cut inside the box without having to slide the pizza back-and-forth, as is usually required with a pizza carton having a regular double-panel front wall. This procedure is expedited by the quick-releasing front corner assembly (i.e., tab 48 engaged with opening 54) and by the specially-contoured second panel of the front wall structure. The specific procedure is as follows. First, open the cover of the box. Second, push side walls 41 inward until tabs 48 disengage from openings 54, thereby allowing the front wall structure to fold outwards and, as a result, disconnecting the two front corners of the box. At this point, a pizza can be placed in the center of panel 21 and cut in position. Finally, the front corners are re-connected by folding panel 51 upright and folding panel 52 downward until interlock portions 59 engage with panel 21. Unlike a regular pizza carton having a double-panel front wall, this last step is possible because recessed portion 58 allows inner panel 52 to swing clear of the pizza as the panel is being folded downward.

If it's not desired to have extension panel 82 disposed diagonally across the front corner of the box (such as when a sauce cup is packed into a corner), then the extension panel can be made to align with main flap 81 by folding the extension panel at line 84. This will enable the panel to fit into the corner of the box or, alternately, will enable the entire side flap structure to be disposed outside the box with the front end of panel 82 being tucked between panels 51 and 52 at the corner, resulting in an external cover flap on the box.

CONCLUSION, RAMIFICATIONS, AND SCOPE

I have disclosed an invention that provides added protection to pizza during packaging and transport operations. Specifically, the invention can provide one or more of the following functions: (1) allow pizza to be cut in a box having a double-panel front wall without need to slide the pizza back-and-forth; (2) eliminate slice-sliding during transit by containing a pizza on eight sides while also providing a square corner for carrying an extra item; (3) reduce cover warping and eliminate use of a deeper box or costly lid support device; and (4) eliminate the wasted space consumed by the gap between panels of a double-panel wall.

To accomplish all the above functions in one box, a variety of structures and a special method have been employed. The structures include a quick-releasing front corner structure, a specially contoured inner panel of a double-panel front wall, an anti-slide cover flap structure, a warp-resistant cover panel, and specially-designed diagonal corner wall structure.

The illustrated number, size, shape, type, and placement of components represent the preferred embodiments; however, many other combinations and configurations are possible within the scope of the invention.

Throughout the discussion, reference was made to packaging pizza. However, it is noted that my invention can be used for packaging other foods and for other applications, as well.

In conclusion, it is understood that my invention is not to be limited to the disclosed embodiments but, on the contrary, is intended to cover various modifications and equivalent arrangements included within the spirit and scope of the appended claims.

I claim:

1. A blank for a box having an improved front wall structure, said blank being of foldable material cut and scored to define:

a bottom panel, a plurality of wall structures hingedly attached to said bottom panel including opposing front and rear wall structures, a cover hingedly attached to said rear wall structure, said front wall structure comprising a first panel hingedly attached to said bottom panel and a second panel hingedly attached to said first panel at a top edge, said second panel having:

(a) a predetermined length, (b) an irregular outer edge opposing said top edge, said irregular outer edge having a recessed medial portion and a pair of interlock portions outlying said recessed medial portion, said recessed medial portion having a predetermined length, (c) a minimum height dimension "A" that is the distance between said recessed medial portion and said top edge and a maximum height dimension "B" that is the distance between one of the interlock portions and said top edge;

wherein said dimension "A" is less than eighty percent of said dimension "B" and said predetermined length of the recessed medial portion is at least twenty percent of said predetermined length of the second panel, whereby when a pizza is disposed in the center of said bottom panel, said front wall structure can be erected and said second panel can be swung downward clear of the pizza without need of sliding said pizza rearwards, and after said blank is folded into a box, the pizza can be disposed in contact with said first panel, thereby allowing for a shorter blank which reduces the amount of material used in manufacture of the blank.

2. A box having an improved double-panel wall structure, said box being of foldable material and comprising:

a bottom panel and a plurality of wall structures including a double-panel wall structure having a first panel hingedly attached to said bottom panel and a second panel hingedly attached to said first panel at a top edge and disposed interior to said first panel, said second panel having:

(a) a predetermined length, (b) an irregular outer edge opposing said top edge, said irregular outer edge having a recessed medial portion and a pair of interlock portions outlying said recessed medial portion, said recessed medial portion having a predetermined length, (c) a minimum height dimension "A" that is the distance between said recessed medial portion and said top edge and a maximum height dimension "B" that is the distance between one of the interlock portions and said top edge;

wherein said dimension "A" is less than eighty percent of said dimension "B" and said predetermined length of the recessed medial portion is at least twenty percent of said predetermined length of the second panel.

3. A box having an improved corner wall structure, said box being of foldable material and comprising:

a bottom panel, a plurality of walls including non-parallel first and second walls hingedly attached to said bottom panel, said first and second walls each having a first end, a corner wall structure comprising a diagonal wall and first, second, and third connector panels, wherein:

said diagonal wall is hingedly attached to the first end of said first wall and has a bottom edge, said first connector panel is hingedly attached to said first wall at said bottom edge, said second connector panel is hingedly attached to said first connector panel, said third connector panel is hingedly attached to said second connector panel and to the first end of said second wall.

4. A blank for a hot food carton having an improved cover, said blank being of corrugated paperboard cut and scored to define:

a tray member comprising a bottom panel and a plurality of walls hingedly attached to said bottom panel, said bottom panel having a predetermined width and a predetermined length, a cover member comprising a cover panel and at least one flap hingedly attached thereto, said cover panel having a predetermined width approximately equal to the width of said bottom panel and a predetermined length approximately equal to the length of said bottom panel, wherein said cover member has anti-warp means comprising a plurality of score lines on a surface of said cover panel, whereby after said blank has been properly folded into a carton and said cover panel has been properly flexed along said plurality of score lines and a hot food product has been placed inside the carton, said cover panel undergoes less downward warping than does a cover panel of a similar food carton lacking said anti-warp means.

5. The blank of claim 4 wherein said plurality of score lines comprises a diagonal score line disposed between non-adjacent edges of said cover panel.

6. The blank of claim 4 wherein said plurality of score lines comprises first and second diagonal score lines converging at an intersection point and forming an X-shape configuration of score lines.

7. The blank of claim wherein said plurality of score lines comprises first and second diagonal score lines forming an approximate V-shape configuration of score lines and having a bottom portion, said bottom portion being adjacent a front edge of said cover panel.

8. The blank of claim 4 wherein said plurality of score lines comprises three score lines converging at an intersection point and forming a Y-shape configuration of score lines, two of the three score lines extending rearward from the intersection point and one of the score lines extending forward from the intersection point toward a front edge of said cover panel.

9. The blank of claim 4 further comprising first and second cover front flaps each directly attached to a front edge of said cover panel.

10. The blank of claim 4 wherein said plurality of score lines comprises at least two separate sets of score lines, each set comprising two score lines disposed at an oblique angle one to another.

11. A hot food carton having an improved cover, said hot food carton being made of corrugated paperboard and comprising:

a tray member comprising a bottom panel and a plurality of walls, said bottom panel having a predetermined width and a predetermined length, a cover member comprising a cover panel and at least one flap hingedly attached thereto, said cover panel having a predetermined width approximately equal to the width of said bottom panel and a predetermined length approximately equal to the length of said bottom panel, wherein said cover panel has first and second diagonal flex-lines converging at an intersection point and forming an X-shape configuration of flex-lines on said cover panel, whereby when a hot food product is placed inside the hot food carton said cover panel undergoes less downward warping than does a cover panel of a similar food carton lacking said X-shape configuration of flex-lines.

12. A blank for a box having improved product anti-slide means, said blank being of foldable material cut and scored to define:

a tray member comprising a bottom panel and a plurality of walls hingedly attached to said bottom panel, a cover member hingedly attached to a wall of said plurality of walls, said cover member comprising a cover panel and product anti-slide means, said product anti-slide means being a flap structure hingedly attached to an edge of said cover panel, said edge having a predetermined length and said flap structure having a predetermined length, said flap structure comprising:

(a) a main flap having a first end and a predetermined length, (b) at least one extension panel hingedly attached to said first end;

wherein:

the predetermined length of the main flap is substantially less than the predetermined length of said edge, the predetermined length of the flap structure is greater than the predetermined length of said edge, whereby after said blank has been folded into a box and said flap structure is disposed inside of said tray member, said extension panel is disposed at an oblique angle to said main flap and extends diagonally between two walls of said box.

13. The blank of claim 12 wherein said at least one extension panel is divided into first and second portions by a secondary fold line, whereby if it is desired for the first portion of said first extension panel to be disposed in alignment with said main flap after said blank has been set up into a box, said extension panel may be folded along said secondary fold line to allow said extension panel to fit in a corner of the box rather than be disposed diagonally between said two walls of the box.

14. A blank for a box having an improved corner wall structure, said blank being of foldable material cut and scored to define:

a bottom panel having a plurality of edges including an end edge, a side edge, and a corner edge extending from the side edge toward the end edge, a plurality of walls including end and side walls hingedly attached at said end and side edges, respectively, a corner wall structure hingedly attached to said side wall and said end wall, said corner wall structure comprising another wall and first and second connector panels, wherein:

said another wall is hingedly attached to an end edge of said side wall and has a bottom edge, said first connector panel has first, second, and third edges and is hingedly attached to the bottom edge of said another wall at said first edge and is hingedly attached to said second connector panel at said second edge, said third edge being free of attachment, said first and second connector panels are free of attachment to said bottom panel.

15. The blank of claim 14 wherein said corner wall structure further comprises a third connector panel disposed between said second connector panel and the end edge of said end wall, said third connector panel being hingedly attached to said second connector panel and to said end wall.

16. The blank of claim 14 further comprising a cover hingedly attached to a top edge of said end wall.

17. A box having an improved corner wall structure, said box being of foldable material and comprising:

a bottom panel having a plurality of edges including a first edge, a second edge, and a corner edge extending from the first edge toward the second edge, a plurality of walls, including first and second walls hingedly attached at said first and second edges, respectively, a corner wall structure hingedly attached to said first wall and said second wall, said corner wall structure comprising a diagonal wall and first and second connector panels, wherein:

said diagonal wall is hingedly attached to an end edge of said first wall and has a bottom edge, said first connector panel has first, second, and third edges and is hingedly attached to the bottom edge of said diagonal wall at said first edge and is hingedly attached to said second connector panel at said second edge, said third edge being free of attachment, said first and second connector panels are free of attachment to said bottom panel.

18. The box of claim 17 wherein said corner wall structure further comprises a third connector panel disposed between said second connector panel and the end edge of said second wall, said third connector panel being hingedly attached to said second connector panel and to said second wall.

19. A box having improved product anti-slide means, said box being of foldable material and comprising:

a tray member comprising a bottom panel and a plurality of walls including perpendicular first and second walls, a cover member comprising a cover panel and product anti-slide means, said product anti-slide means being a flap structure hingedly attached to said cover panel, wherein at least a portion of said flap structure is disposed diagonally between said first and second walls, whereby after a sliced pizza is placed into the box, said at least a portion of said flap structure deters pizza slices from sliding toward a corner of the box.

20. The box of claim 19 wherein said flap structure comprises:

(a) a main flap having a first end, (b) an extension panel hingedly attached to said first end;

wherein:

said main flap is disposed parallel to said first wall, said extension panel is disposed at an oblique angle to said main flap and diagonally between said first and second walls.

21. A blank for a box having an improved rear corner wall structure, said blank being of foldable material cut and scored to define:

a bottom panel, a plurality of walls and wall structures including a rear wall, a side wall, and a rear corner wall structure, a cover hingedly attached to said rear wall;

wherein:

said rear corner wall structure is connected to said side wall and to said rear wall and is free of attachment to said cover, said rear corner wall structure comprises:

(a) a diagonal wall hingedly attached to a rear end of said side wall, (b) a unitary plurality of hingedly connected connector panels hingedly attached to a bottom edge of said diagonal wall and to an end edge of said rear wall, (c) a free-swinging corner flap hingedly attached to an end of said diagonal wall, said free-swinging corner flap being free of attachment to said unitary plurality of hingedly connected connector panels;

whereby after said blank has been erected into a box said diagonal wall is disposed between said side wall and said rear wall, said unitary plurality of hingedly connected connector panels hingedly links said diagonal wall to said rear wall, and said free-swinging corner flap is disposed at an angle to said diagonal wall and substantially parallel to said rear wall.

22. A carton having an improved structure, said carton comprising:

a bottom panel, opposing front and rear walls, a first side wall disposed perpendicular to said front wall, another wall directly attached to a rear end of said first side wall and hingedly attached at a bottom edge to a connector panel, a cover connected to a top edge of said rear wall.

23. A carton having an improved structure, said carton comprising:

a bottom panel, opposing front and rear walls, a first side wall disposed perpendicular to said front wall, another wall directly attached to a rear end of said first side wall, a plurality of hingedly connected connector panels hingedly attached to said another wall and to said rear wall, a cover connected to a top edge of said rear wall.

24. The carton of claim 23 wherein said plurality of hingedly connected connector panels is free of attachment to said cover and at least one of the panels in said plurality of hingedly connected connector panels is hingedly attached to a bottom edge of said another wall.

25. The carton of claim 23 wherein said plurality of hingedly connected connector panels is free of attachment to said bottom panel.

26. A blank for a box having an improved structure, said blank being of foldable material cut and scored to define:

(a) a bottom panel having a plurality of edges including:

(i) parallel front and rear end edges, (ii) a side edge disposed perpendicular to said front edge, (iii) a corner edge adjacent said side edge and extending toward and at least part way to said rear edge;

(b) a plurality of walls and panels including:

(i) front and rear walls hingedly attached to said bottom panel at said front and rear end edges, respectively, (ii) a cover panel hingedly attached to said rear wall, (iii) a side wall hingedly attached to said bottom panel at said side edge, (iv) another wall directly attached to a rear end of said side wall, (v) a unitary plurality of hingedly connected connector panels hingedly attached to a bottom edge of said another wall and to an end edge of said rear wall, said unitary plurality of hingedly connected connector panels being free of attachment to said cover panel.

27. The blank of claim 26 further comprising:

a panel hingedly attached to a top edge of said front wall at a fold line, a cover flap hingedly attached to a front edge of said cover panel.

28. The blank of claim 27 further comprising:

a cover interlock means disposed adjacent said fold line, whereby after said blank is erected into a box said cover interlock means provides an opening that receives said cover flap and, thereby, secures said cover panel in a closed position.

29. The blank of claim 27 further comprising:

a free-swinging corner flap hingedly attached to an end of said another wall, whereby after said blank is erected into a box said corner flap is disposed at an angle to said another wall.

30. The blank of claim 27 further comprising additional structure including at least one structural element selected from the group consisting of product anti-slide means and cover panel anti-warp means;

said product anti-slide means comprising a main flap hingedly attached to a side edge of said cover panel and an extension panel hingedly attached to a front end of said main flap, whereby after said blank has been erected into a box and said product anti-slide means is disposed inside of said box, said extension panel is disposed at an oblique angle to said main flap and extends diagonally between said side wall and said front wall;

said cover panel anti-warp means comprising a plurality of score lines on a surface of said cover panel, whereby after said blank has been erected into a box and said cover panel has been properly flexed along said plurality of score lines and a hot food product has been placed inside the box, said cover panel undergoes less downward warping than does a cover panel of a similar food carton lacking said anti-warp means.

* * * * *